United States Patent [19]

Sakata

[11] Patent Number: 5,017,970

[45] Date of Patent: May 21, 1991

[54] FIXING DEVICE WITH MOVABLE NIP REGION FOR USE IN COPIERS

[75] Inventor: Toshio Sakata, Toyokawa, Japan

[73] Assignee: Minolta Camera Kabuahiki Kaisha, Osaka, Japan

[21] Appl. No.: 213,229

[22] Filed: Jun. 29, 1988

[30] Foreign Application Priority Data

Jun. 30, 1987 [JP] Japan ..... 62-164979
Jul. 1, 1987 [JP] Japan ..... 62-164175

[51] Int. Cl.[5] ..... G03G 15/20

[52] U.S. Cl. ..... 355/290; 219/216; 219/469; 355/285; 162/271

[58] Field of Search ..... 355/14 FU, 3 FU, 208, 355/282, 285, 289, 290; 219/216, 469; 432/60; 100/93 RP, 158 R, 168, 176; 162/270, 271

[56] References Cited

U.S. PATENT DOCUMENTS 3,945,726 3/1976 Ito et al. ..... 355/290 X
4,192,229 3/1980 Tsunoi et al. ..... 355/3 FU X
4,475,896 10/1984 Bains ..... 162/271 X
4,610,530 9/1986 Lehmbeck et al. ..... 355/3 TR X
4,632,533 12/1986 Young ..... 355/3 FU X

FOREIGN PATENT DOCUMENTS 0008876 1/1985 Japan ..... 355/3 FU
0239274 10/1986 Japan ..... 355/3 FU

*Primary Examiner*—A. T. Grimley
*Assistant Examiner*—Robert Beatty
*Attorney, Agent, or Firm*—Wenderoth, Lind & Ponack

[57] ABSTRACT

A fixing device for use in copiers. First and second rotatable members are in contact with each other so as to form a nip region through which a substrate is transported to fix a toner image, supported thereon, by heat and pressure. The fixing device is so constructed that the position of the nip region between the rotatable members is angularly displaced in accordance with the amount of anticipated or actual curl of the substrate.

10 Claims, 7 Drawing Sheets

FIXING DEVICE WITH MOVABLE NIP REGION FOR USE IN COPIERS

FIELD OF THE INVENTION

The present invention relates to a fixing device used in electrophotographic copy machines and printers which fixes a transferred toner image to a sheet of copy paper, and more specifically relates to a fixing device which provides a rotatable fixing member, set, such as heat rollers, that fixes an unfused toner image to the sheet of copy paper by means of heat and pressure.

BACKGROUND OF THE INVENTION

In the present type of fixing device, curling is generated in various directions relative to a copy paper processing direction after copy paper transits a fixing device, this curling being caused both by differences in the heating conditions for the obverse and reverse sides of the copy paper and differences in the moisture evaporation loss due to the dissolution of the toner induced by the heating and pressure required to fix the toner to the copy paper. This curl causes paper jams when the copy paper is transported, as well as defects in paper condition when the copy paper is discharged to the receiving tray, thereby causing concern that unsatisfactory composite and duplex copies will be produced.

Conventional devices have a paper transport path from the heating roller which curves in the reverse direction to that in which the curl is produced so as to allow elimination of curling by drawing the copy paper through this curved portion of the paper transport path, thereby correcting the aforesaid curl and avoiding the resultant drawbacks (for example, Japanese Laid-Open patent Publication Sho 60-50547).

In the aforesaid conventional construction, however, resistance to or blockage of in-transit copy paper may occur when the paper transits the curved portion of the curved paper path, thereby raising concern that the paper will not transit smoothly.

SUMMARY OF THE INVENTION

A main object of the present invention is to provide a superior fixing device which can eliminate copy paper curl.

A further object of the invention is to provide a fixing device which is constructed so as to cause angular displacement of the position of the nip region when copy paper is inserted between two rotating members.

These and other objects are accomplished by a fixing device which has two rotatable members disposed in opposition and is constructed so as to allow the position of the nip region between the rotatable members to be displaced at an angle. Modification of the aforesaid nip region is suitable made based upon the percentage of moisture content.

In the aforesaid construction, paper which curls due to passage through a fixing device is drawn in a direction opposite to the curl by the rotatable fixing member set having a modified nip region position, and is subsequently discharged without a curl.

BRIEF DESCRIPTION OF THE DRAWINGS

These and other objects or features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Figure 1:
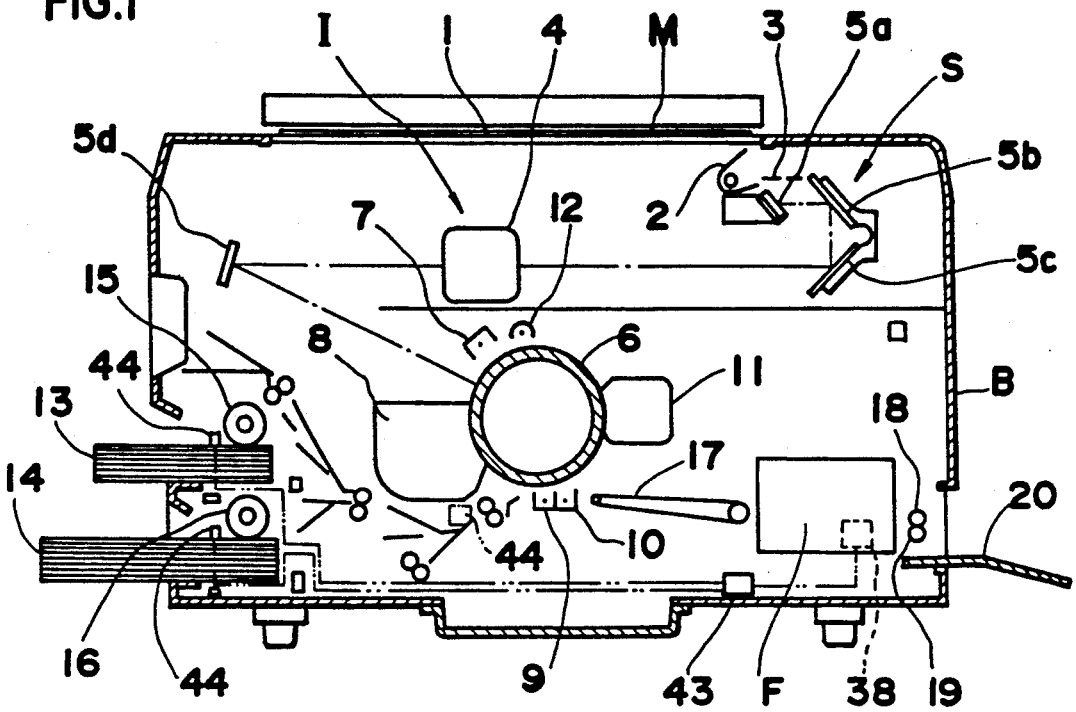
FIG. 1 is a sectional view showing a simplified electrophotographic copy machine.

FIG. 1 is a simplified sectional view of a slit-scanning type electrophotographic copier provided with a fixing device according to the present invention.

In the electrophotographic copier, an original document M, disposed upon a document platen 1 comprised of glass or like material, is exposed to light from an exposure lamp 2, and the light image from the original document M passes through slit 3 to an image forming optical system I comprised of an image forming lens 4 and a plurality of mirrors 5*a* to 5*d* which then in turn projects the image upon a photosensitive drum 6.

The exposure lamp 2, slit 3 and first mirror 5*a* comprise a scanner S which travels in a leftward direction in the drawing at a speed v so as to scan the original document M. Second mirror 5*b* and third mirror 5*c* travel at ½ the speed v, i.e., at a speed of v/2, in a leftward direction in the drawing in order that the image forming optical system can maintain a constant image forming optical path.

The light image from the original document M scanned by the scanner S is then formed upon the surface of the photosensitive drum 6 which rotates in a counterclockwise direction in the drawing, thereby forming an electrostatic latent image thereon which corresponds to the aforesaid light image.

Around the circumference of the photosensitive drum 6 are arranged a charger 7 which charges the surface uniformly, developing unit 8 which adheres toner to the electrostatic latent image formed by the light projected by the image forming optical system 1 thereby developing said electrostatic latent image, transfer unit 9 which transfers the toner image to copy paper P, separation unit 10 which separates the copy paper P from the photosensitive drum 6 after the toner image is transferred, cleaning unit 11 which removes residual toner that adheres to the surface of the photosensitive drum 6 after image transfer, and eraser lamp 12 which eliminates the charge from the surface of the photosensitive drum 6 after the toner image is transferred. The aforesaid copy paper P may be either of two sizes stored in separate paper feed cassettes 13 and 14; the copy paper P of the indicated size is extracted one sheet at a time by a pick up roller (15 or 16) and delivered to the transfer unit 9.

After the toner image on the surface of the photosensitive drum 6 is transferred by the transfer unit 9, copy paper P is separated from the photosensitive drum 6 and delivered to fixing device F by the feed belt 17. Thereafter, the transferred toner image is fused to the copy paper P by the fixing device F, and the copy paper P is then discharged from the copy machine B to a discharge tray 20 by discharge rollers 18 and 19.

The construction and operation of the aforesaid fixing device F is described hereinafter.

Figure 2:
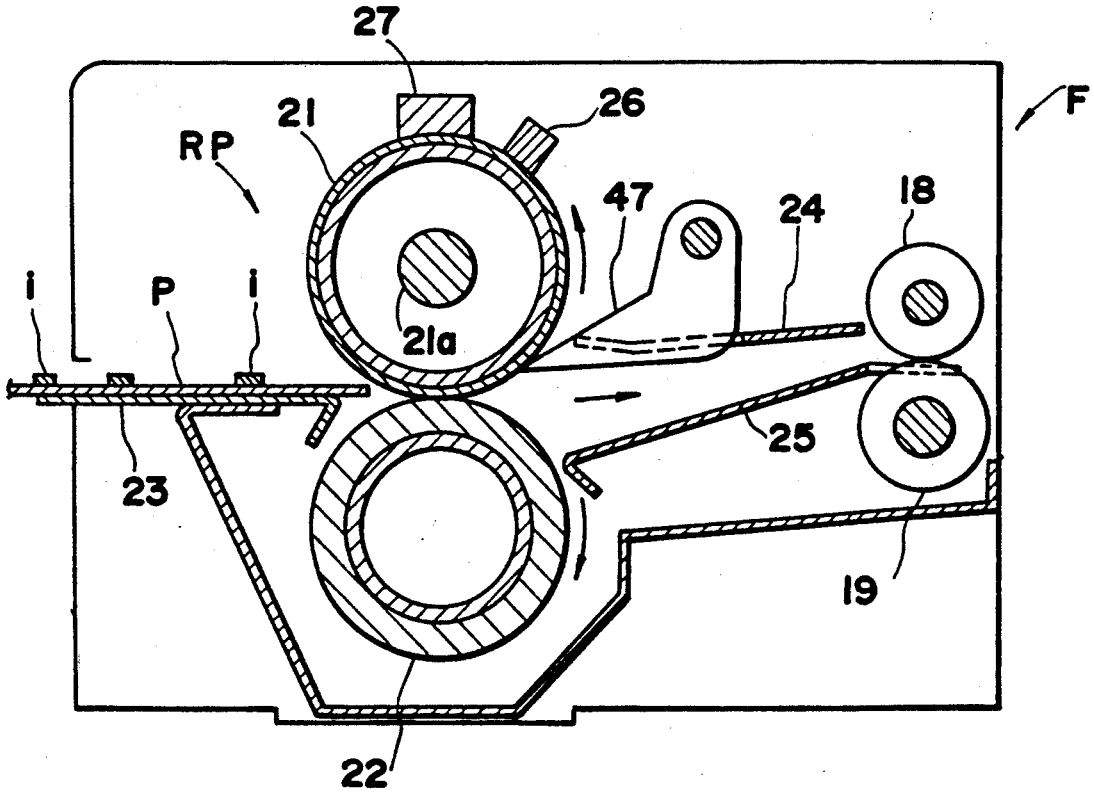
FIG. 2 is a sectional view showing a simplified fixing device.

As shown in FIG. 2, heat roller 21 and pressure roller 22 are disposed so as to oppose each, other in the feed path of the copy paper P. After the copy paper P with the unfused toner i adhering to the upper surface is extracted from the separation device 10, it is transported medially between both of the rollers 21 and 22 by the feed belt 17 and guided by a guide panel 23.

The heat roller 21 includes a tetrafluoroethylene resin layer on its surface which has superior release properties, and is constructed so as to be rotatable in the counterclockwise direction in the drawing, by means of a driving unit (not shown in the drawings). The heat roller 21 is also provided with an internal heater 21*a* by which the copy paper P is heated as the paper P passes medially between both rollers 21 and 22.

The pressure roller 22 is comprised of an LTV rubber layer on its surface which has superior release properties, and is freely rotatable and supported so as to apply the pressure to heat roller 21, thereby pressing the paper P against the heat roller 21.

The unfused toner image i adhering to the paper P is heat fused by the combined action of the heat supplied by the internal heater 21*a* of heat roller 21 and the pressure applied to the paper P by the pressure roller 22 in the direction toward the heat roller, thus fixing the toner image to the surface of the copier paper P.

After the toner image is fixed, the paper P passes medially between rollers 21 and 22 and is subsequently separated from the surface of the heat roller 21 by a separation pawl 47. The copy paper P is then guided by upper and lower guide panels 24 and 25 and removed from the fixing device F by discharge roller set 18 and 19.

In addition, a cleaning device 26 comprising a felt material which removes adhering toner, and a thermistor 27 which detects surface temperature are attached to the heat roller 21 so as to make contact with the surface thereof.

The fixing device F has a position modification means SC which corrects the curl produced in the copy paper P as the paper P passes medially between the rollers 21 and 22 by altering the opposed positioning of fixing roller set RP which comprises the heat roller 21 and the pressure roller 22. A description of the construction and operation of the position modification means SC follows hereinafter.

Figure 3A:
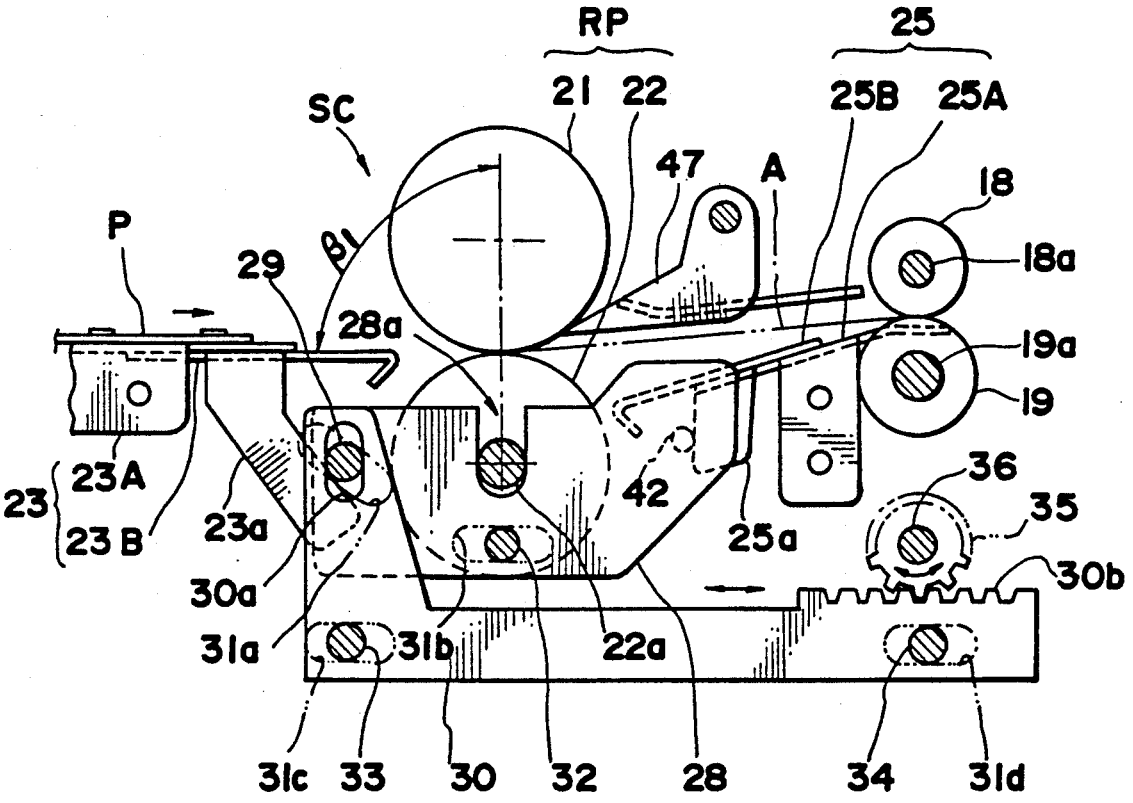
FIGS. 3A, 3B and 3C are plan views showing a fixing device of the the present invention.
Figure 3B:
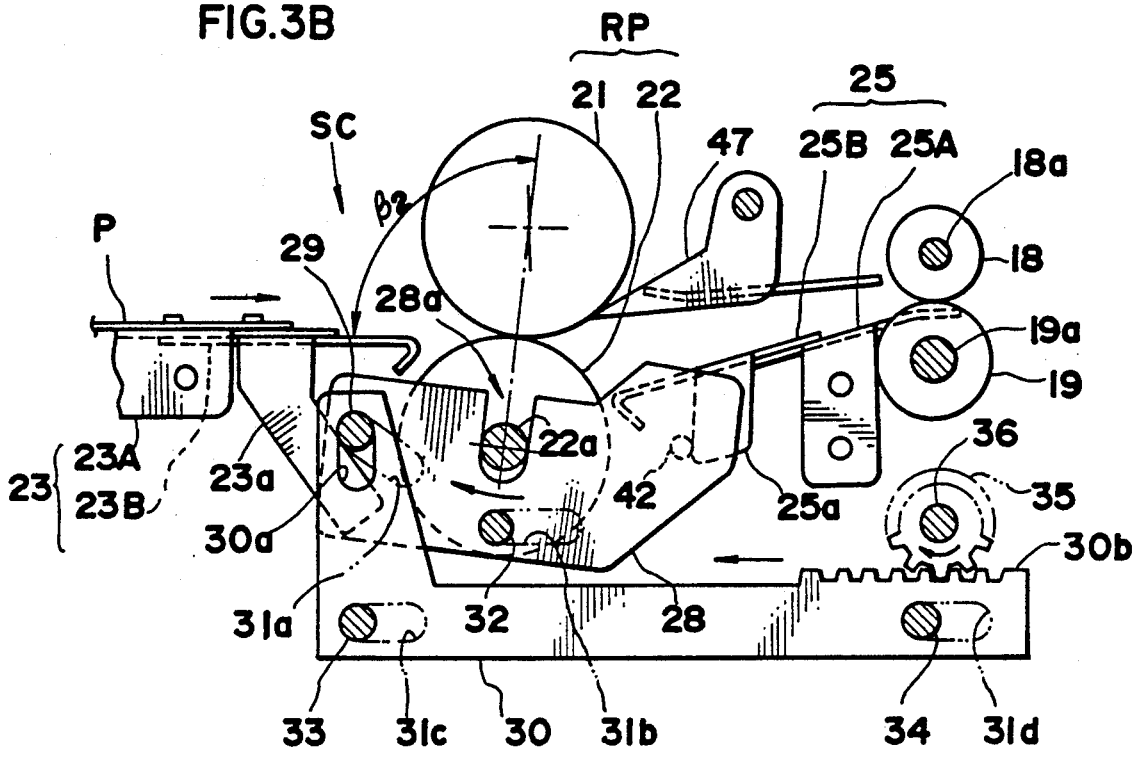
Figure 4:
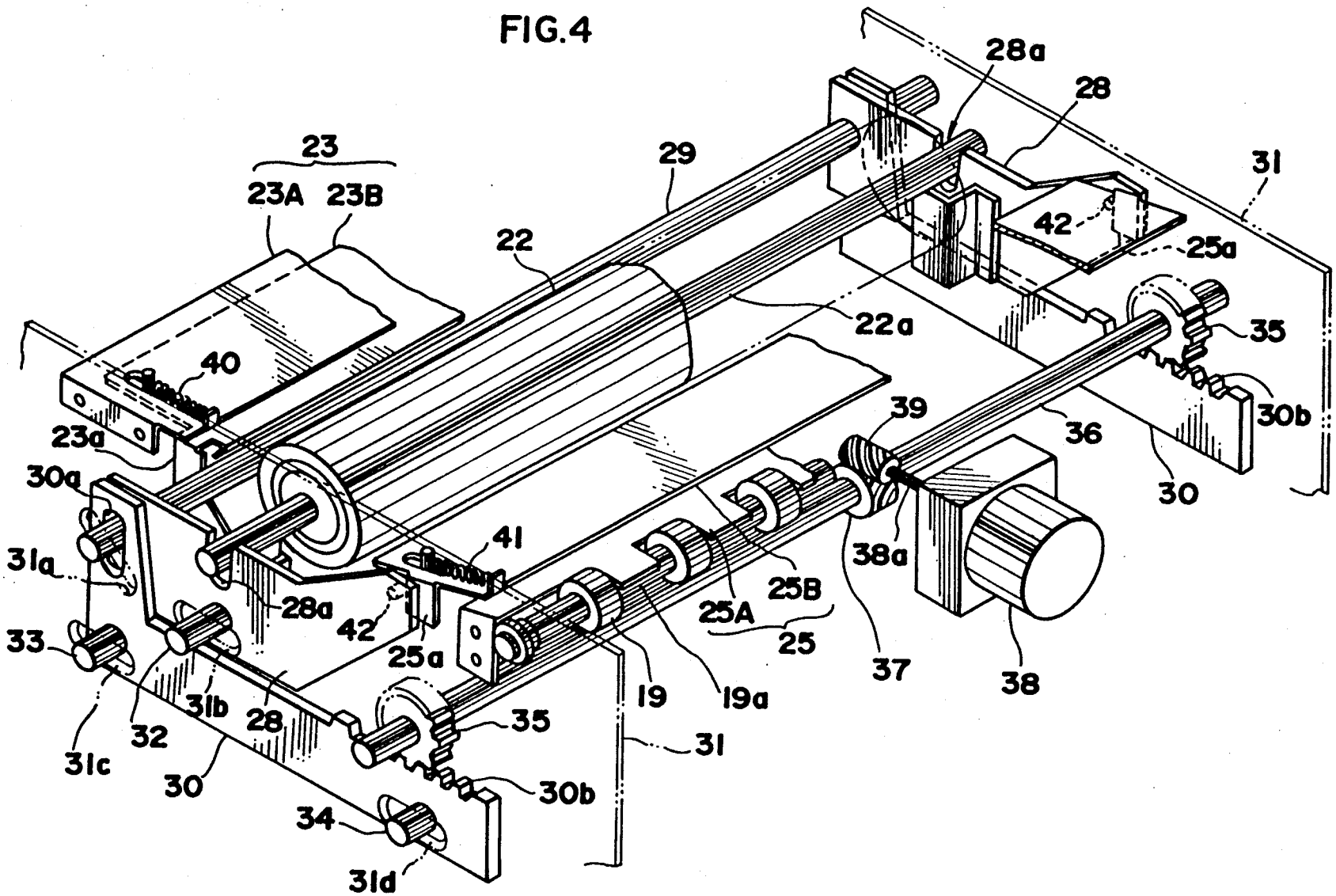
FIG. 4 is a perspective view of the fixing device of the present invention.

As shown in FIGS. 3A, 3B and 4, a mounting shaft 22*a* of the pressure roller 22 is supported by a notch 28*a* formed in support panels 28 located on both the right and left sides of the roller 22. The right and left support panels 28 are also continuously supported by support shaft 29. Both ends of the support shaft 29 extend beyond the support panels 28, and penetrate slots 30*a* which are oriented in a vertical direction in moveable members, 30 which can travel parallel to the paper feed direction (the horizontal direction), and are further supported by slots 31*a* which are oriented in an oblique direction in side panels 31 of a case for fixing device F. Additionally, pin sets 32 which project laterally from support panels 28 are inserted in slots 31*b* which are oriented in a horizontal direction in the side panels 31.

Figure 3C:
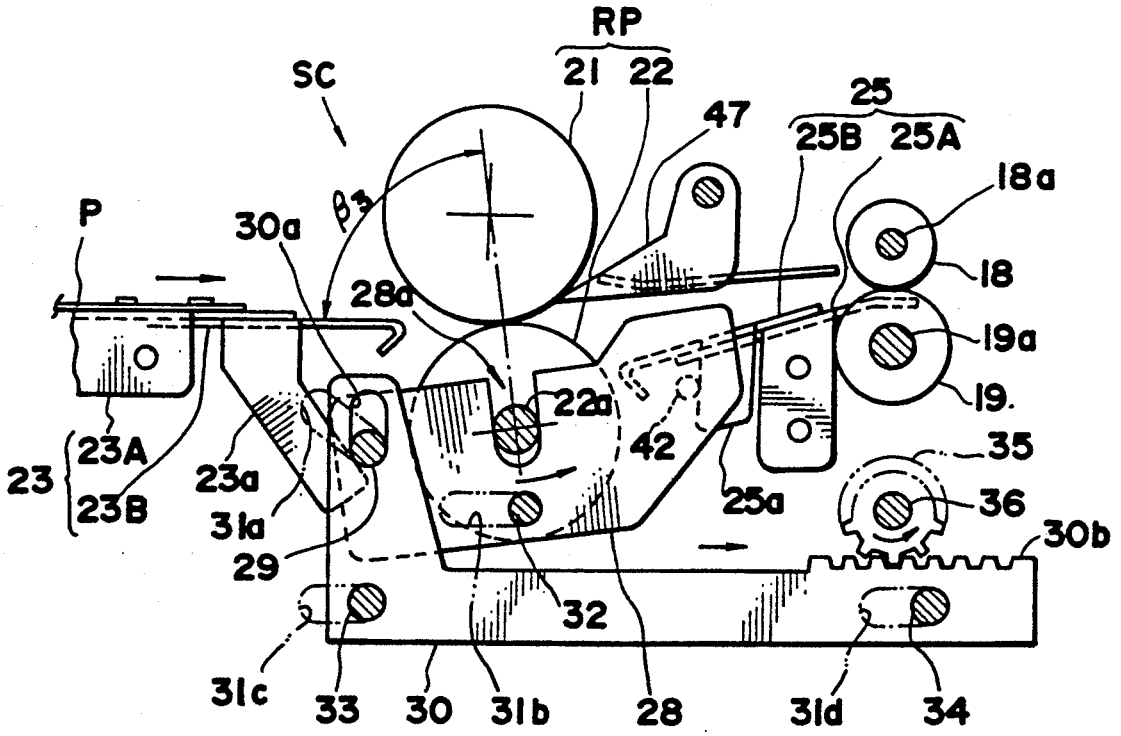

As shown in FIGS. 3A, 3B and 3C, the aforesaid mounting structure is constructed in such a way that the support panels 28, which maintain the pressure roller 22, rotate about the mounting shaft center of the heat roller 21 in conjunction with the travel of the moveable members 30.

Right and left moveable members 30 are provided with pin sets 33 and 34 which are disposed so as to project laterally into slots 31*c* and 31*d* respectively which are oriented in a horizontal direction in side panel 31, thereby making the right and left moveable members 30 moveable in the horizontal direction. On a portion of each of the right and left moveable members 30 are formed racks 30*b* which are engaged by pinion gear sets 35. Worm gear 37 is attached to a rotating axle 36, which is connected to the pinion gear sets 35, and meshes with a worm 39 which is fixedly attached to a drive shaft 38*a* of motor 38. The moveable members 30 can be moved in the horizontal direction by the forward and reverse operation of the motor 38.

In addition to the aforesaid support panels 28 and moveable members 30, the rotating shaft 36 and mounting shafts 18*a* and 19*a* of discharge roller set 18 and 19 are supported by the side panel 31 of the fixing device F.

FIG. 3A shows the normal state of the nip position of the discharge roller set 18 and 19 on a line A tangent to the heat roller 21 at the nip end position of the fixing roller set RP. In this normal state, the copy paper P, which is transported and gripped between heat roller 21 and pressure roller 22, is advanced toward the discharge roller set 18 and 19 without being bent.

Thus, curling is not produced as the paper P passes the fixing device F, and uncurled paper P can be obtained continuously by maintaining the position of the fixing roller set RP in the position indicated in FIG. 3A.

FIG. 3B shows the state wherein the moveable members 30 are moved leftwardly in the drawing by the rotation of the motor 38. The support panels 28 move in a clockwise direction (in the drawing) around the mounting shaft center of heat roller 21 via the coordinated operation of the support shafts 29 of the support panels 28 and the slots 30*a* of the moveable members 30, and the pressure roller 22 which is supported by the support panels 28 is rotated in the same direction. Thereupon, a straight line between the mounting shaft center of the heat roller 21 and the mounting shaft center of the pressure roller 22 forms an angle $\beta 2$ relative to the paper transport direction, the angle $\beta 2$ being larger than an angle $\beta 1$ which describes the normal position, as shown in FIG. 3A. In this state, the end of the nip of the fixing roller set RP is below the aforesaid tangent line A, and copy paper P which is gripped and transported by the fixing roller set RP is then bent toward the pressure roller 22 while being transported,.thereby producing a curl in the downward direction in the drawing (hereinafter referred to as "back curl").

Accordingly, when a curl in an upward direction (hereinafter referred to as a "face curl") is or may be produced in copy paper P, the face curl can be counteracted by modifying the position of the fixing roller set RP so as to induce a back curl, this position modification being accomplished by changing the position of the fixing roller set RP and maintaining this modified position, thereby allowing a curl-free copy paper P to be obtained.

FIG. 3C shows the state wherein the moveable members 30 have been moved to the right in the drawing by means of the rotation of the motor 38. The support panels 28 move in a counterclockwise direction (in the drawing) around the mounting shaft center of the heat roller 21 via the coordinated operation of the support shafts 29 of the support panels 28 and the slots 30*a* of the moveable members 30, and the pressure roller 22 which is supported by the support panels 28 is rotated in the same direction. Thereupon, the straight line which links the mounting shaft center of heat roller 21 and the mounting shaft center of pressure roller 22 forms an angle $\beta 3$ relative to the paper P transport direction, the angle $\beta 3$ being smaller than the angle $\beta 1$ which describes the normal position, as shown in FIG. 3A. In this state, the end of the nip of the fixing roller set RP is above the aforesaid tangent line A, and copy paper P which is gripped and transported by the fixing roller set RP is then bent toward heat roller 31 while being transported, thereby producing a face curl.

Accordingly, when a back curl is or may be produced in copy paper P, the back curl can be counteracted by modifying the position of the fixing roller set RP so as to induce a face curl, this position modification being accomplished by changing the position of the fixing roller set RP and maintaining the modified position, thereby allowing a curl-free copy paper P to be obtained.

Since the curling produced on the paper P in the portion that comes into contact with the fixing roller set RP can be corrected by means of the aforesaid position modification means SC, it is unnecessary to provide a mechanism farther along on the paper feed path to manipulate the paper P to physically eliminate the curl, thereby reducing any failures in paper transport properties.

On the other hand, the aforesaid embodiment is constructed so as to prevent failure of paper transport properties by maintaining constant spacing between a guide panel 23 anterior to fixing roller set RP and the pressure roller 22, as well as between a guide panel 25 posterior to and beneath the fixing roller set RP and the pressure roller 22 in spite of the position modification of the pressure roller 22. The construction and operation of the aforesaid configuration follows hereinafter.

As shown in FIGS. 3A, 3B, 3C and 4, the aforesaid two guide panels 23 and 25 comprise fixed members 23A and 25A which are fixedly mounted to the side panels 31 respectively, and slide members 23B and 25B which are mounted so as to be slidable along the fixed members 23A and 25A. The slide members 23B and 25B are moveable by means of springs 40 and 41 provided for each of the respective members. A bent component 23*a* is provided on the slide member 23B for positioning the slide member 23B by contact with the support shaft 29 of the support panels 28. In addition, a bent component 25*a* is provided on the slide member 25B for positioning the slide member 25B by contact with a pin 42 which projects from the support panels 28.

The two guide panels 23 and 25 individually expand and contract relative to the pressure roller 22 so as to maintain constant spacing with the pressure roller 22 by modifying the stop positions of the two slide members 23B and 25B by means of the support shaft 29 and the pin 42 moving in conjunction with modification of the position the support panel 28 during the positioning of the fixing roller set RP.

As shown in FIG. 1, the operation of the motor 38, which alters the position of the fixing roller set RP, is controlled by a the control means comprising microcomputer 43. Output signals are transmitted to microcomputer 43 from a set of moisture sensors 44 provided at the paper feed cassettes 13 and 14 to measure the moisture content rate of copy paper P. Microcomputer 43 controls the operation of the aforesaid motor 38 so as to modify the position of the fixing roller set RP in exact accordance with the moisture content rate detected by the moisture content sensors 44.

Figure 5:
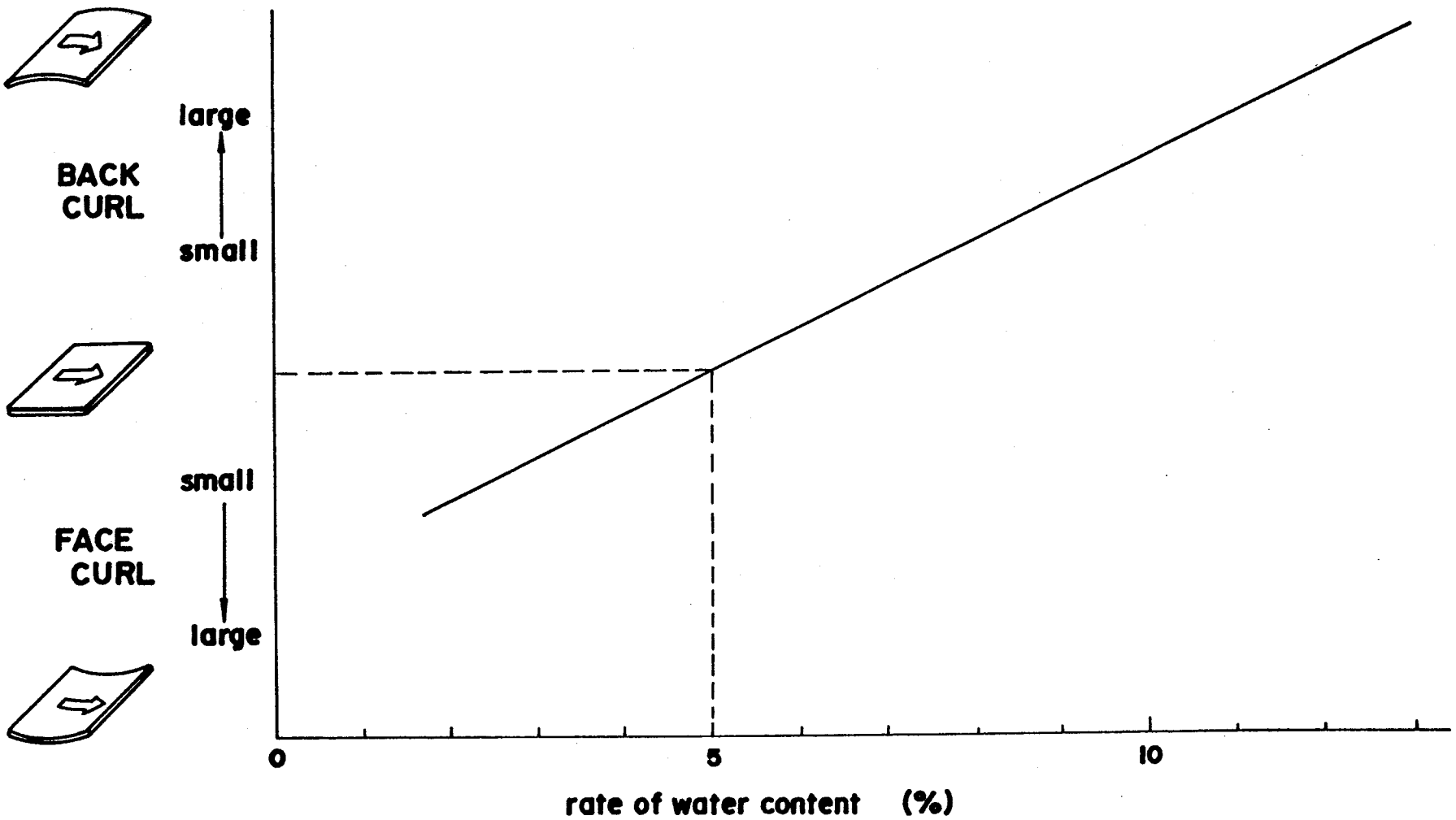
FIG. 5 is a graph which indicates the percentage moisture content and describes the conditions for curl generation.

The amount of curl that will be produced after the copy paper P transits the fixing device is known by the amount of moisture contained in said paper P. More specifically, common paper which has a moisture content near 5% will be virtually flat, while a higher moisture content will cause back curl and, conversely, a lower moisture content will cause face curl, as shown in FIG. 5.

Thus, based on this relationship, the microcomputer 43 controls the operation of the motor 38 so as to form the position indicated in FIG. 3A wherein the nip position in the paper feed direction is the same as that when the moisture content rate detected by the moisture sensors 44 is at the prescribed value of 5%, or forms the inclined position illustrated in FIG. 3B when the detected moisture content is less than 5%, or forms the the inclined position described in FIG. 3C when the detected moisture content is greater than 5%.

The aforesaid moisture sensors 44 can use any of several measurement methods, such as measuring the electrical resistance and converting the resistance value into the moisture content rate, or measuring the moisture content rate from the transmittance of microwaves for papers.

Modification of the pressure roller position in accordance with the moisture content rate may involve three stages as in the present embodiment, several more stages, or may be continuous.

The 5% moisture content rate that forms the reference is the value to use with most common paper, but the reference value may be changed in accordance with the type of paper.

The position of the moisture content sensors 44 may also be located on the paper fed path, e.g., may be disposed anterior to the transfer device 9, as shown by the dotted line in FIG. 1. When arranged in this way, only one moisture sensor need be deployed without regard for the number of paper feed cassettes.

Figure 6:
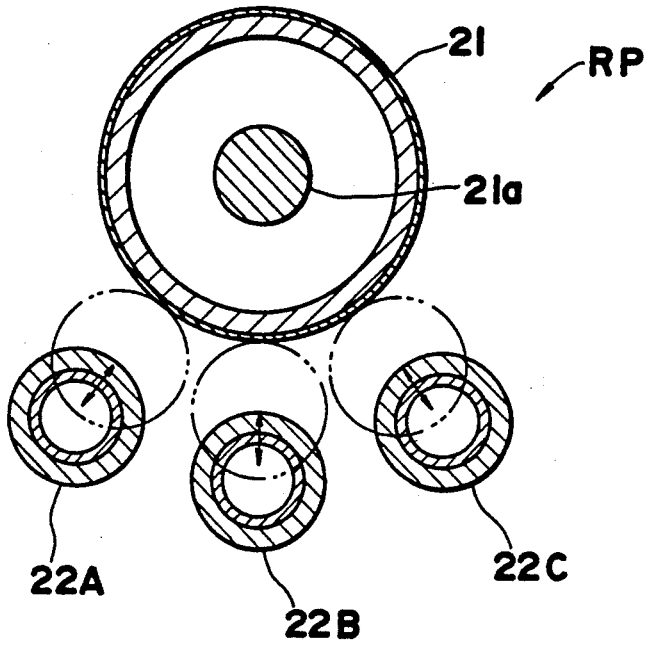
FIG. 6 is a sectional plan view of a fixing device which illustrates another embodiment of the present invention.
Figure 7:
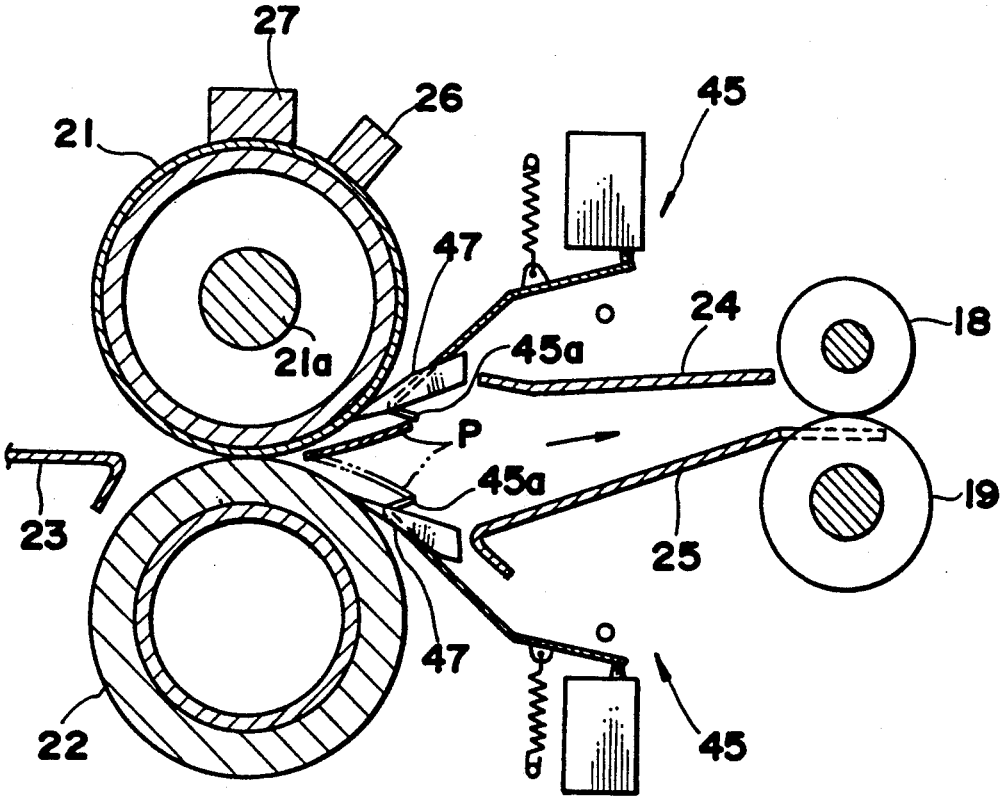
FIG. 7 is a sectional plan view of a fixing device which illustrates still another embodiment of the present invention.
Figure 8:
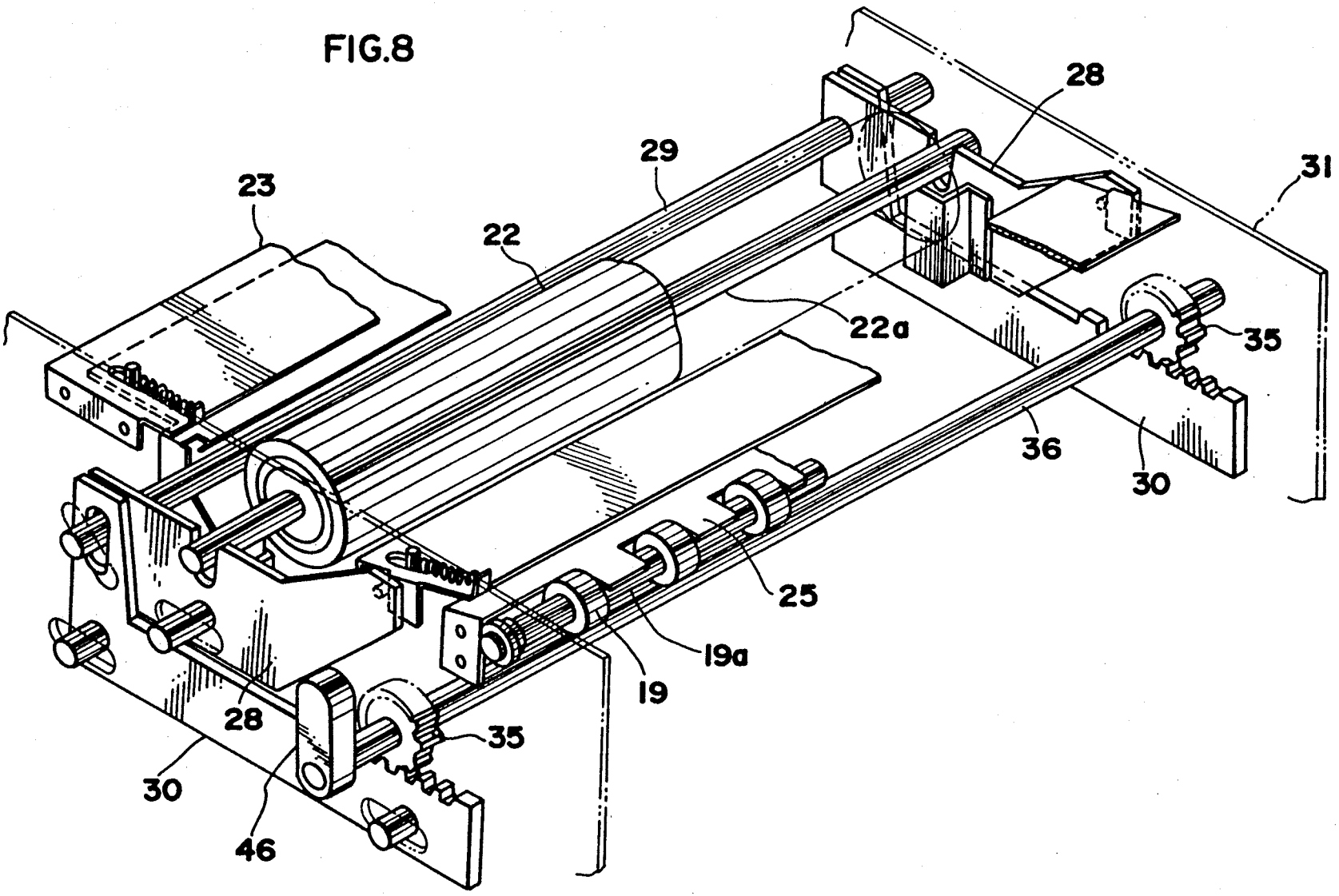
FIG. 8 is a perspective view of a fixing device which illustrates still another embodiment of the present invention.

FIGS. 6, 7 and 8 show other embodiments of the invention.

FIG. 6 shows a rotatable fixing member set RP comprising an individual top rollers 21, and three bottom roller 22A, 22B and 22C which alternatively contact and apply pressure to the top roller 21 and are disposed in a row along the paper transport path. This embodiment employs a position modification means which modifies the nip position of the rotatable fixing member set RP relative to the paper transport path by having one or another of the bottom rollers (22A, 22B or 22C) make contact with the top roller 21.

FIG. 7 shows the use of a sensor for detecting paper curl rather than moisture content. A sensor set 45 for detecting face of back curl, comprising a microswitch that detects the direction of curl by making contact with the paper P relative to sensor component 45*a*, is provided. The modification direction for the rotatable fixing member set RP position is switched in accordance with the results detected by the curl detecting sensor 45. A plurality of curl detecting sensors 45 may be deployed to detect multi-level curls and switch multi-level position modifications for the rotatable fixing member set RP.

As shown in FIG. 8, motor 38, which is the drive source for the position modification means SC, is not used. Instead, one end of the rotating shaft 36 is provided with an operation lever 46 which projects to the exterior of the copy machine housing. The operator switches the position modification direction of the rotatable fixing member set RP and increases or decreases the position modification by manually operating operation lever 46 in accordance with the amount and type of curl produced in the paper P, as determined by visual inspection.

The following points should be considered with regard to the present invention.

In substituting the configuration of the fixing roller set RP by combining the heat roller 21 and pressure roller 22, one or both rollers (21 and/or 22) may be replaced by a belt-shaped member. Fixing action derived from both rollers 21 and 22, as well as a belt-shaped member are claimed as from the rotatable fixing member.

A heater may be internally provided at both ends of the rotatable fixing member, or may be provided outside said rotatable fixing member so as to heat the surface thereof.

The position modification means can employ any of several configurations. The device for modifying position may be either a top or bottom rotating member or both. The moving function may combine both horizontal and vertical movement.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for fixing a toner image to a substrate, comprising:

a first rotatable member mounted in a frame;

a second rotatable member in contact with said first rotatable member to thereby define a nip region;

means for angularly displacing the axis of rotation of said second member about the axis of rotation of said first member;

a substrate transfer path extending through said nip region;

detecting means for detecting the curl condition of the substrate; and control means for controlling said displacing means in response to output from said detecting means.

2. A fixing device for fixing a toner image to a substrate, comprising:

a first rotatable member having a first axis of rotation;

a second rotatable member disposed downwardly with respect to said first rotatable member and having a second axis of rotation, said second rotatable member contacting said first rotatable member to thereby define a nip region;

means for guiding the substrate in a substrate input direction extending tangentially of said first rotatable member toward said nip region, said first rotatable member being in pressing contact with the guided substrate at a developed image side on which the developed image is formed and said second rotatable member being in pressing contact with the substrate at the side opposite to said developed image side; and means for changing the position of said nip region relative to said substrate input direction, said means for changing the position of said nip region including means for angularly displacing said second axis of rotation about said first axis of rotation, whereby said second axis of rotation remains a substantially constant distance from said first axis of rotation during angular displacement of said second axis of rotation about said first axis of rotation.

3. A fixing device as in claim 2, wherein said changing means includes a support means rotatably mounting said second rotatable member, said support means being mounted for angular displacement about said first axis of rotation of said first rotatable member.

4. A fixing device for fixing a toner image to a substrate, comprising:

a first rotatable member having a first axis of rotation;

a second rotatable member having a second axis of rotation, said second rotatable member contacting said first rotatable member to thereby define a nip region;

means for guiding the substrate in a substrate input direction extending tangentially of said first rotatable member toward said nip region;

means for changing the position of said nip region relative to said substrate input direction, said means for changing the position of said nip region including means for angularly displacing said second axis of rotation about said first axis of rotation;

means for detecting a condition affecting the curl of the substrate; and control means for controlling said means for changing the position of said nip region in response to output from said detecting means;

wherein said control means controls said changing means such that an angle measured upstream of said nip region and formed between a line extending through said axes of rotation of said first and said second rotatable members and a line parallel to said substrate input direction is greater when a substrate face curl affecting condition is detected by said detecting means than when a substrate back curl affecting condition is detected by said detecting means.

5. A fixing device for fixing a toner image to a substrate, comprising:

a first rotatable member;

a second rotatable member contacting said first rotatable member to thereby define a nip region;

means for guiding the substrate in a substrate input direction extending tangentially of said first rotatable member;

means for changing the position of said nip region relative to said substrate input direction;

means for detecting a condition affecting the curl of the substrate; and control means for controlling said changing means in response to output from said detecting means.

6. A fixing device as in claim 5, wherein said detecting means includes a moisture detector.

7. A fixing device as in claim 5, wherein said control means controls said changing means such that when no substrate curl affecting condition is detected by said detecting means, the substrate is guided through said nip region substantially horizontally, when a substrate face curl affecting condition is detected by said detecting means, the substrate is guided through said nip region downwardly, and when a substrate back curl affecting condition is detected by said detecting means, the substrate is guided through said nip region upwardly.

8. A fixing device as in claim 7, wherein an angle formed between a line extending through said axes of rotation of said first and said second rotatable members and a line parallel to said substrate input direction, and measured upstream of said nip region, is greater when a substrate face curl affecting condition is detected by said detecting means than when a substrate back curl affecting condition is detected by said detecting means.

9. A fixing device for fixing a toner image to a substrate, comprising:

a first rotatable member;

a second rotatable member contacting said first rotatable member to thereby define a nip region;

means for guiding the substrate toward said nip region in a substrate input direction extending tangentially of said first rotatable member, said guiding means being movable in said substrate input direction;

means for changing the position of said nip region relative to said substrate input direction; and means for moving said guiding means according to the position of said nip region.

10. A fixing device as in claim 9, further comprising: transporting means provided posterior to said first and second rotatable members for transporting the substrate discharged by the first and second rotatable members in a substrate discharging direction;

second guiding means movable in the substrate discharging direction for guiding the substrate between said transporting means; and means for moving said second guiding means according to the position of said nip region.

* * * * *